United States Patent [19]

Ilvento

[11] Patent Number: 4,835,985

[45] Date of Patent: Jun. 6, 1989

[54] ICE ACCOMMODATING SLEEVE APPARATUS FOR COOLING KEGS

[76] Inventor: Robert Ilvento, 29 Maple Ave., West Long Branch, N.J. 07764

[21] Appl. No.: 201,831

[22] Filed: Jun. 3, 1988

[51] Int. Cl.[4] ..... F25D 3/08

[52] U.S. Cl. ..... 62/372; 62/400; 62/457.1; 62/464

[58] Field of Search ..... 62/400, 457, 372, 464, 62/463; 383/901; 220/DIG. 1, DIG. 14

[56] References Cited

U.S. PATENT DOCUMENTS 3,308,636 3/1967 Schaaf ..... 62/464 X 3,443,397 5/1969 Donovan et al. ..... 62/400 X 4,514,993 5/1985 Johnson ..... 62/372

4,653,290 3/1987 Byrne ..... 62/400 X

*Primary Examiner*—Lloyd L. King

*Attorney, Agent, or Firm*—Arthur L. Plevy

[57] ABSTRACT

A portable cooling apparatus for cooling a keg has a cylindrical or truncated cone shaped sleeve made of semi-rigid water-proof material which is open at both ends. The sleeve is slipped over the keg and clamped at its lower end to the lower portion of the keg with a barrel lock or strap. The upper end faces upward and is flared open by the semi-rigid structure of the sleeve material, which allows ice to be filled in and packed directly around the sides of the keg. The sleeve can have pleats or slats at its lower end which are gathered around the keg, and a drainage spout for allowing water to drain out from the lower end of the sleeve.

7 Claims, 1 Drawing Sheet

ICE ACCOMMODATING SLEEVE APPARATUS FOR COOLING KEGS

FIELD OF INVENTION

This invention relates to a portable cooler apparatus for cooling a keg or barrel, and particularly, to sleeve-type member which fits over the outside of a barrel for holding ice around the oustide of the barrel.

BACKGROUND OF INVENTION

It is a conventional practice to cool beer kegs and barrel-shaped containers of drinkable liquids by immersing at least the bottom portion of the keg in an open container filled with ice. Another type of portable cooler apparatus, such as shown in U.S. Pat. No. 3,443,397 to Donovan et al or U.S. Pat. No. 3,614,875 to McCallun, has an inner container or liner open at the top for receiving a barrel therein and an outer container joined to but spaced from the inner container for filling ice around the inner container. In U.S. Pat. No 4,514,993 to Johnson, a sleeve-type cooler apparatus is formed as a cylindrical jacket with an open bottom for slipping over a barrel and a plurality of vertically seamed pockets for holding ice and the like to cool the barrel.

The conventional devices mentioned above have the following problems and disadvantages. Since beer kegs and refreshment barrels often have their spigots at the lower portion near the bottom of the keg, they cannot be immersed in ice in an open container above the height of the spigot, thereby limiting the amount of ice that can be placed in cooling contact around the keg. With the open-top double walled container, the keg must be lowered into the inner liner, which precludes use of kegs with lower spigots as well as risks damage to or tearing of the liner.

In the sleeve-type cylindrical jacket having internal pockets, the requirement that the ice be filled in the pockets reduces its effectiveness in cooling the barrel since the ice cannot be directly packed around the sides of the barrel. Such seamed jacket coolers are also relatively expensive to fabricate and are susceptible to tearing, leaking, and weakening over time.

SUMMARY OF INVENTION

In order to overcome the above mentioned disadvantages and problems of prior art cooler apparatuses, it is a principal object of the invention to provide a portable cooler apparatus for cooling a keg or barrel which is portable, simple to install, and has a high cooling efficiency by allowing ice to be packed in direct contact around the sides of the barrel. It is a further object that the portable cooler apparatus be very inexpensive to make so that it can be thrown away after one or a few uses and the owner does not feel compelled to retain it for repeated usage.

In accordance with the invention, a portable cooling apparatus for cooling a keg comprises a cylindrical or truncated cone shaped sleeve made of semi-rigid water-proof material which is open at both ends. The sleeve is slipped over the keg and clamped at its lower end to the lower portion of the keg with a barrel lock or strap. The upper end faces upward and is flared open by the semi-rigid characteristic of the sleeve material, which allows ice to be filled in and packed around the sides of the keg. The sleeve can have pleats or slats at its lower end which are gathered around the keg and tightly clamped thereto with the barrel lock or strap. The apparatus also includes a drainage spout for allowing water to drain out from the lower end of the sleeve.

BRIEF DESCRIPTION OF FIGURES

The above objects and advantages and further features of the invention are described in detail below in conjunction with the drawings, of which.

DETAILED DESCRIPTION OF INVENTION

Figure 1:
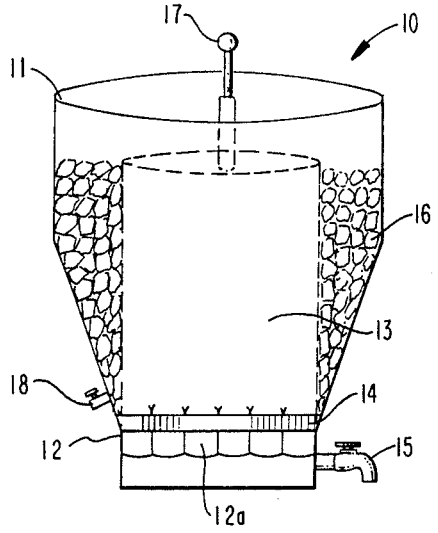
FIG. 1 is a perspective view of a portable cooler apparatus installed around a keg in accordance with the invention.

Referring to FIG. 1, a portable cooler apparatus of the present invention includes a sleeve member 10 having an open upper end 11 and an open lower end 12. The sleeve member is made of semi-rigid water-proof material that is very inexpensive, such as styrofoam or waxed cardboard, so that it is inexpensive to make and can be disposed of after one or a few uses without any significant economic penalty. The sleeve is slipped over a keg 13 and fastened or clamped at its lower end 12 to the lower portion of the keg. If the keg has a spigot at its lower portion, the sleeve can be clamped just above the spigot 15, as shown in FIG. 1.

The sleeve is clamped using a barrel lock 14, of the type having a threaded bolt which meshes with slits formed in a banded strap. Alternatively it can be fastened to the keg using an elastic band or a strap which cinches around the keg 13. The inner peripheral surface of the lock or belt 14 can be coated with a layer of foam rubber or other absorbent material to provide better locking while serving to absorb water. The sleeve is generally in the shape of a cylinder or inverted, truncated cone so that when the lower end is clamped on the keg, the semi-rigid structure of the sleeve material holds the upper end 11 upright and ready to receive ice 16 to be packed around the sides of the keg 13.

Figure 2:
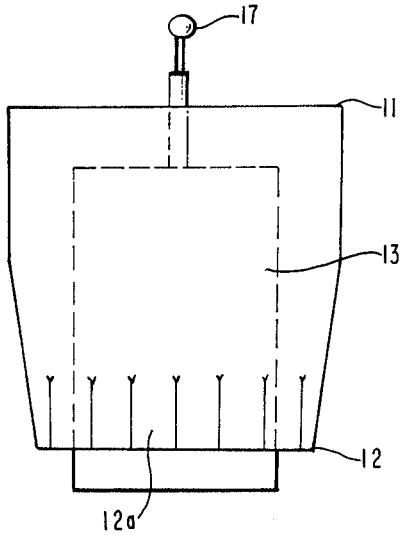
FIG. 2 is a partial front elevational view of the construction of the sleeve member for the apparatus of FIG. 1.

The lower end 12 of the sleeve can have pleats or dovetailed slats 12a arranged circumferentially around the lower end, which are gathered when the lower end is clamped around the keg, as indicated by the arrows in FIG. 2, in order to conform the lower end around the lower portion of the keg. The tap or pressurizer pump 17 for the contents of the keg extends through the open upper end 11 of the sleeve member 10.

There is shown a drainage spout 18 which operates in conjunction with a single valve or stopper mechanism and allows excessive water to be drained from the hollow of the sleeve as caused by melting ice. The sleeve can accommodate all different shaped kegs due to the nature of the same.

As is apparent from the foregoing description, a very inexpensive, portable cooler apparatus is provided which can be thrown away after one or a few uses without economic penalty. The sleeve is made of semi-rigid water-proof material so that it has sufficient structure to stand upright to receive ice therein. Materials such as styrofoam, waxed cardboard, or paperboard are particularly suitable since they are light weight, inexpensive, and can even be folded flat for ease of carrying. The clamping portion can simply be a heavy duty elastic band or, for firmer pressure, a barrel lock or strap can be used. The cooler apparatus of the invention has the further advantages of ease of installation and high cooling efficiency, and can be used with kegs which have lower spigots as well as those that have upper taps.

Based on the above description, it is understood that the sleeve can be thrown away after one or more uses, but it is also understood that a more durable sleeve can be fabricated from a suitable plastic or other material. A major aspect of the apparatus is to provide an inexpensive keg cooler which can be conveniently stacked in a store or other location for sale or rental by a consumer.

The specific embodiments of the invention described above are intended to be illustrative only, and many other variations and modifications may be made thereto in accordance with the principles of the invention. All such embodiments and variations and modifications thereof are considered to be within the scope of the invention, as defined in the following claims.

I claim:

1. A portable cooler apparatus for cooling a keg having generally cylindrical sides, comprising:

a sleeve member made of semi-rigid water-proof material which is open at its upper and lower ends, wherein its lower end is slipped over the keg and clamped to a lower portion of the keg; and clamping means for clamping said lower end of said sleeve member to the lower portion of the keg, whereby said clamping means creates a water-tight seal between said sleeve member and said keg, wherein said upper end of said sleeve member faces upward and is flared open around the sides of the keg thereby forming a pouch into which material can be packaged around the sides of the keg.

2. A portable cooling apparatus according to claim 1, wherein said lower end of said sleeve member is formed with a plurality of pleats or slats arranged circumferentially around said lower end, to allow said lower end to be gathered around and to conform to the lower portion of the cylindrical sides of the keg.

3. A portable cooling apparatus according to claim 1, further comprising a drainage spout formed at said lower end for allowing water to drain out from said sleeve member.

4. A portable cooling apparatus according to claim 1, wherein said sleeve member is made of a material selected from the group of styrofoam, waxed cardboard, and paperboard.

5. A portable cooling apparatus according to claim 1, wherein said sleeve member has an inverted, truncated cone shape.

6. A portable cooling apparatus according to claim 1, wherein said sleeve member has a generally cylindrical shape.

7. A portable cooler apparatus for cooling a keg having generally cylindrical sides, comprising:

a sleeve member made of semi-rigid water-proof material which is open at its upper and lower ends, the lower end being formed with a plurality of pleats or slats arranged circumferentially thereabout, wherein its lower end is slipped over the keg such that the pleats or slats gather around and conform to the lower portion of the cylindrical sides of the keg where they are clamped thereto; and clamping means for clamping said lower end of said sleeve member to the lower portion of the keg, wherein said upper end of said sleeve member faces upward and is flared open around the sides of the keg by the material to be filled in and packaged around the sides of the keg.

* * * * *